US005924635A

United States Patent [19]

Koshimizu et al.

[11] Patent Number: 5,924,635

[45] Date of Patent: Jul. 20, 1999

[54] VIBRATION ISOLATING INSTALLATION MECHANISM FOR A DISPOSER

[75] Inventors: Satoru Koshimizu, Hachioji; Katsumi Shimizu, Hiratsuka; Shigeru Maruyama, Sagamihara; Kazuhiro Suzuki, Kawasaki; Kazuto Onodera, Sagamihara, all of Japan

[73] Assignee: Taisei Corporation, Tokyo, Japan

[21] Appl. No.: 09/075,258

[22] Filed: May 11, 1998

[51] Int. Cl.[6] ..... B02C 18/42

[52] U.S. Cl. ..... 241/46.015

[58] Field of Search ..... 241/46.013, 46.014, 241/46.015, 46.016

[56] References Cited

U.S. PATENT DOCUMENTS

| | | | |
|---|---|---|---|
| 3,684,199 | 8/1972 | Bebinger | 241/100.5 |
| 3,839,752 | 10/1974 | Brown et al. | 4/191 |
| 4,253,616 | 3/1981 | Timmer | 241/46 B |
| 4,337,901 | 7/1982 | Ogura | 241/46 B |
| 5,318,230 | 6/1994 | Ferguson et al. | 241/46.013 |
| 5,377,362 | 1/1995 | Jackson | 4/292 |

*Primary Examiner*—Joseph J. Hail, III
*Assistant Examiner*—William Hong
*Attorney, Agent, or Firm*—Townsend&Banta

[57] ABSTRACT

In the vibration isolating installation mechanism for a disposer of the present invention, a flexible cylinder with vibration isolatability and a suspension structure with vibration isolatability are used together, to support the disposer proper under an outlet-connected cylinder. The vibration isolating installation comprises an outlet-connected cylinder installed in the outlet of a sink by a clamp, to protrude downward, a disposer-installing cylinder for installing a disposer proper, a flexible cylinder connected between the outlet-connected cylinder and the disposer-installing cylinder, a support cylinder placed around the outlet-connected cylinder, support collars protruded horizontally respectively from the support cylinder and the disposer-installing cylinder, mating fitting holes formed in the support collars of both the cylinders at the respectively corresponding positions, support rods loosely fitted in the respectively mating fitting holes through an elastic bush respectively, and stoppers fitted at both the ends of each of the support rods.

19 Claims, 12 Drawing Sheets

VIBRATION ISOLATING INSTALLATION MECHANISM FOR A DISPOSER

BACKGROUND OF THE INVENTION

The present invention relates to a vibration isolating installation mechanism for a kitchen refuse disposer.

Kitchen refuse disposers are popularly used mainly in the United States of America, but they involve the problems of waste water treatment and noise. Since a disposer is installed below an outlet-connected cylinder (chute) installed below the outlet of a sink, the vibration of the disposer proper is transmitted through the outlet-connected cylinder to the sink outlet and presented as noise. So, any measure must be taken to prevent the noise.

FIG. 12 shows a conventional disposer installation mechanism as an example. Symbol a denotes a sink plate, and inside a low step portion b lower than the sink plate a, an outlet is formed. Symbol c denotes an outlet-connected cylinder, i.e., a chute. The outlet-connected cylinder c has an externally threaded portion e formed outside, to be engaged with a clamp d, and has a flange f to be mounted on the low step portion b at the top, and also has an installing portion h for installing the disposer proper g at the bottom.

In this structure, with a rubber packing i kept between the flange f and the low step portion b, the clamp d is tightened to install the outlet-connected cylinder c in the sink outlet, and then with a rubber packing j kept between the top of the disposer proper g and the installing portion h, a clamp k is tightened, to install the disposer proper g to the outlet-connected cylinder c. So, if the clamp k is loosened, the disposer proper g can be removed from the outlet-connected cylinder c for maintenance.

In the above installation mechanism, the respective rubber packings i and j placed between the flange f of the outlet-connected cylinder c and the low step portion b of the outlet, and between the installing portion h and the disposer proper g are provided for water seal, and are kept compressed. So, they do not contribute to inhibiting the transmission of vibration effectively. Therefore, the noise caused by the vibration of the disposer proper g cannot be sufficiently reduced.

The object of the present invention is to overcome this problem by effectively decreasing that the vibration of the disposer proper g is transmitted through the outlet-connected cylinder to the sink, for inhibiting the generation of noise.

SUMMARY OF THE INVENTION

The constitution of the present invention to solve the above problem is described below. The vibration isolating installation mechanism for a disposer of the present invention comprises an outlet-connected cylinder installed in the outlet of a sink by a clamp, to protrude downward, a disposer-installing cylinder for installing a disposer proper, a flexible cylinder connected between the outlet-connected cylinder and the disposer-installing cylinder, a support cylinder placed around the outlet-connected cylinder, support collars protruded horizontally respectively from the support cylinder and the disposer-installing cylinder, mating fitting holes formed in the support collars of both the cylinders at the respectively corresponding positions, support rods loosely fitted in the respectively mating fitting holes through an elastic bush respectively, and stoppers fitted at both the ends of each of the support rods.

As another version of the present invention, the vibration isolating installation mechanism for a disposer also comprises an outlet-connected cylinder installed in the outlet of a sink by a clamp, to protrude downward, a disposer-installing cylinder for installing a disposer proper, a support cylinder placed around the outlet-connected cylinder, a flexible cylinder connected between the support cylinder and the disposer-installing cylinder, support collars protruded horizontally respectively from the support cylinder and the disposer-installing cylinder, mating fitting holes formed in the support collars of both the cylinders at the respectively corresponding positions, support rods loosely fitted in the respectively mating fitting holes through an elastic bush respectively, and stoppers fitted at both the ends of each of the support rods.

In the above constitution, the support cylinder can be threadedly engaged with the outside of the outlet-connected cylinder independent of the clamp, or can be integrally formed with the clamp at its bottom and threadedly engaged with the outlet-connected cylinder.

In the above constitution, since the disposer proper is supported by the flexible cylinder and the suspension structure respectively with vibration isolatability, the spring constant of the flexible cylinder itself can be kept smaller to enhance the vibration isolating effect without impairing the support strength.

Furthermore, in the above constitution, if the flexible cylinder is formed like a bellows, both sufficient vibration isolation and sufficient durability can be achieved since the spring constant can be kept small even if the flexible cylinder is formed by a thick material.

Still furthermore, in the above constitution, the tip of the outlet-connected cylinder can be protruded into the disposer-installing cylinder or the tip of the support cylinder can be protruded into the disposer-installing cylinder. In these cases, since the kitchen refuse falling into the sink outlet is guided into the disposer proper through the disposer-installing cylinder, without any contact with the inside surface of the flexible cylinder, the flexible cylinder can be prevented from being deteriorated or damaged. Moreover, the flexible cylinder can also be formed as a simple cover for the falling kitchen refuse, etc. In this case, since it is not necessary to take any special strength, vibration isolatability, etc. into account, an antimicrobial rubber suitable for use in such a place can be used as the material of the cover though a compromise in such properties is necessary.

Still furthermore, in the above constitution, for the support collar of at least the disposer-installing cylinder, elastic tubes such as elastic bushes can be installed between the stopper and the elastic bush at each of the support rods. Moreover, a compression coil spring can be installed between the stopper and the support collar at each of the support rods, instead of the elastic tubes.

In the above constitution, since a suspension structure in which elastic portions are compressed by loads is adopted, the disposer proper is kept safely supported even if the elastic portions are damaged, and though the elastic portions are kept long to enhance the vibration isolating effect in the vertical direction, they are not buckled by compressive force since the support rods are passed through them.

As a further other version of the present invention, the vibration isolating installation mechanism for a disposer can comprise an outlet-connected cylinder installed in the outlet of a sink by a clamp, to protrude downward, a disposer-installing cylinder for installing a disposer proper, a support cylinder placed around the outlet-connected cylinder, and a flexible cylinder connected between the support cylinder and the disposer-installing cylinder, wherein the tip of the outlet-connected cylinder is protruded into the disposer-installing cylinder.

This constitution does not have the advantage due to the suspension structure, but has the above mentioned advantages that vibration is isolated by the flexible cylinder connected between the support cylinder and the disposer-installing cylinder, and that the kitchen refuse, etc. falling from the sink outlet does not contact the flexible cylinder, to prevent it from being deteriorated or damaged.

DETAILED DESCRIPTION OF THE INVENTION

Embodiments of the vibration isolating installation mechanism for a disposer of the present invention are described below in detail in reference to drawings. In the respective embodiments, the same components are indicated by the same symbols in the respective drawings.

Figure 1:
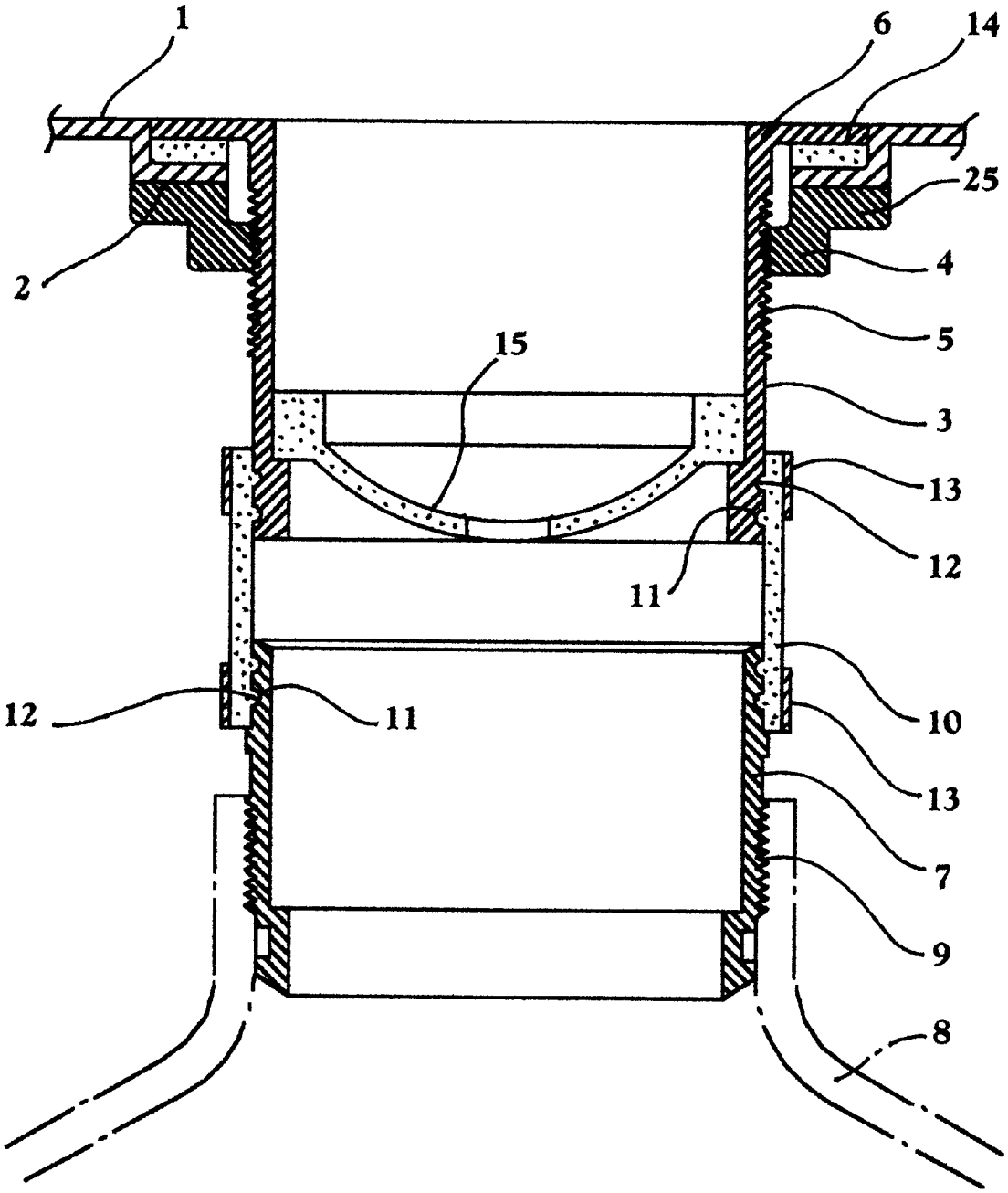
FIG. 1 is a vertical sectional view showing an embodiment of the basic structure of the vibration isolating installation mechanism for a disposer of the present invention.

The basic structure of the vibration isolating installation mechanism for a disposer of the present invention is described in reference to FIG. 1.

In FIG. 1, symbol 1 denotes the bottom plate of a sink, and the sink plate 1 has a low step portion 2 formed at a level lower than the plate 1, with an outlet formed inside the low step portion 2. Symbol 3 denotes an outlet-connected cylinder, so-called chute, and the outlet-connected cylinder has an externally threaded portion 5 formed outside, to be threadedly engaged with a clamp 4, and also has a flange 6 formed at the top to be mounted on the low step portion 2.

Symbol 7 denotes a disposer-installing cylinder for installing a disposer proper 8. The disposer proper 8 can be installed to the disposer-installing cylinder 7, by the above mentioned conventional installation mechanism, or by forming an externally threaded portion 9 outside the disposer-installing cylinder 7, so that the externally threaded portion 9 can be threadedly engaged with an internally threaded portion formed at the top of the disposer proper 8, or by any other proper means.

In the above structure, a flexible cylinder 10 is connected between the bottom of the outlet-connected cylinder 3 and the top of the disposer-installing cylinder 7. To describe the method of connecting the flexible cylinder 10, in this embodiment, engaging grooves 11 are formed around the outlet-connected cylinder 3 at its bottom and around the disposer-installing cylinder 7 at its top, while ridges 12 to be engaged with said engaging grooves 11 are formed on the inside surface of the flexible cylinder 10 at its top and bottom, so that the ridge 12 formed at the top of the flexible cylinder 10 can be engaged with the engaging groove 11 formed at the bottom of the outlet-connected cylinder 7 and that the ridge 12 formed at the bottom of the flexible cylinder 10 can be engaged with the engaging groove 11 formed at the top of the disposer-installing cylinder 7. The connection thus achieved is further reinforced by the clamp bands 13 tightened around the flexible cylinder 10. Any other connection method can be adopted arbitrarily.

The flexible cylinder 10 expected to isolate vibration is made of a material to satisfy the properties required as a vibration isolating material, that is, an elastic material with elasticity over a wide range, not permanently set by any applied load or vibration, having a sufficient strength and durability to support the disposer proper 8, and inexpensive. For example, a material such as rubber can be applied.

In the above structure, if the clamp 4 is tightened with a rubber packing 14 kept between the flange 6 and the low step portion 2, the rubber packing 14 and the low step portion 2 can be caught between the collar portion 25 of the clamp 4 and the flange 6, to install the outlet-connected cylinder 3 in the outlet, for supporting the disposer-installing cylinder 7 in suspension through the flexible cylinder 10. Subsequently, using the externally threaded portion 9, etc., the disposer proper 8 can be installed to the disposer-installing cylinder 7, to be supported. The disposer proper 8 can be removed as required for maintenance, etc.

When the disposer proper 8 is operated, the kitchen refuse falling into the outlet-connected cylinder 3 open in the sink falls through a flexibly openable cover 15, the flexible cylinder 10 and the disposer-installing cylinder into the disposer proper 8, and is disposed by a rotary cutter, etc. In this case, the vibration of the disposer proper 8 is transmitted to the flexible cylinder 10 through the disposer-installing cylinder 7, but the propagation of the vibration to the outlet-connected cylinder 3 is inhibited by the flexible cylinder 10. Therefore, the energy of the vibration transmitted to the sink from the disposer proper 8 is damped to lower the noise level.

For the flexible cylinder 10, to inhibit the transmission of vibration, it is preferable to keep the spring constant of the flexible cylinder 10 smaller by using a softer, longer and thinner vibration isolating material, but to support the disposer proper 8, it is preferable to secure a strength, durability, etc., by adopting a reverse means. So, the required performance is contradictory.

Figure 2:
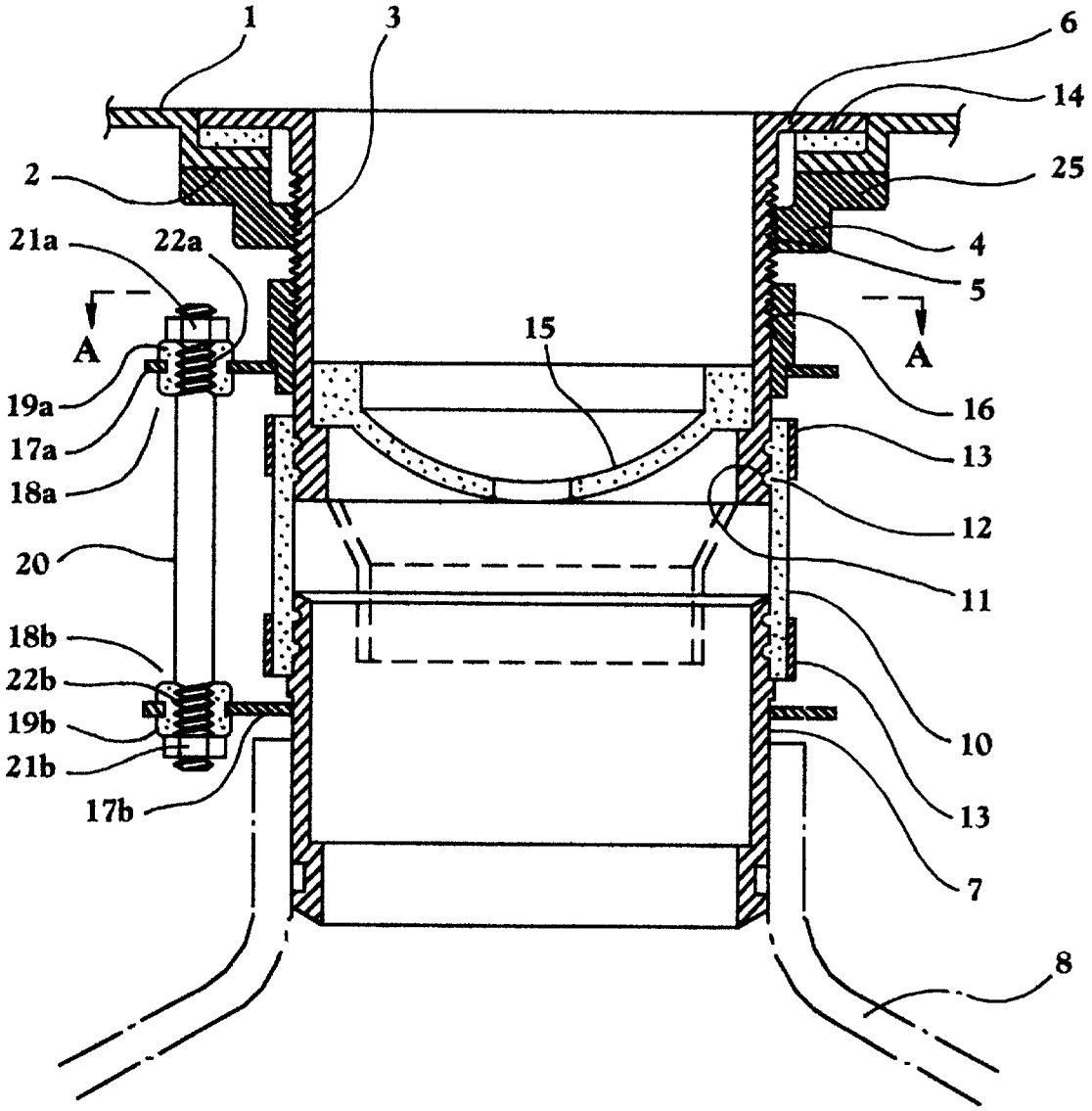
FIG. 2 is a vertical sectional view showing an embodiment of the vibration isolating installation mechanism for a disposer of the present invention.
Figure 3:
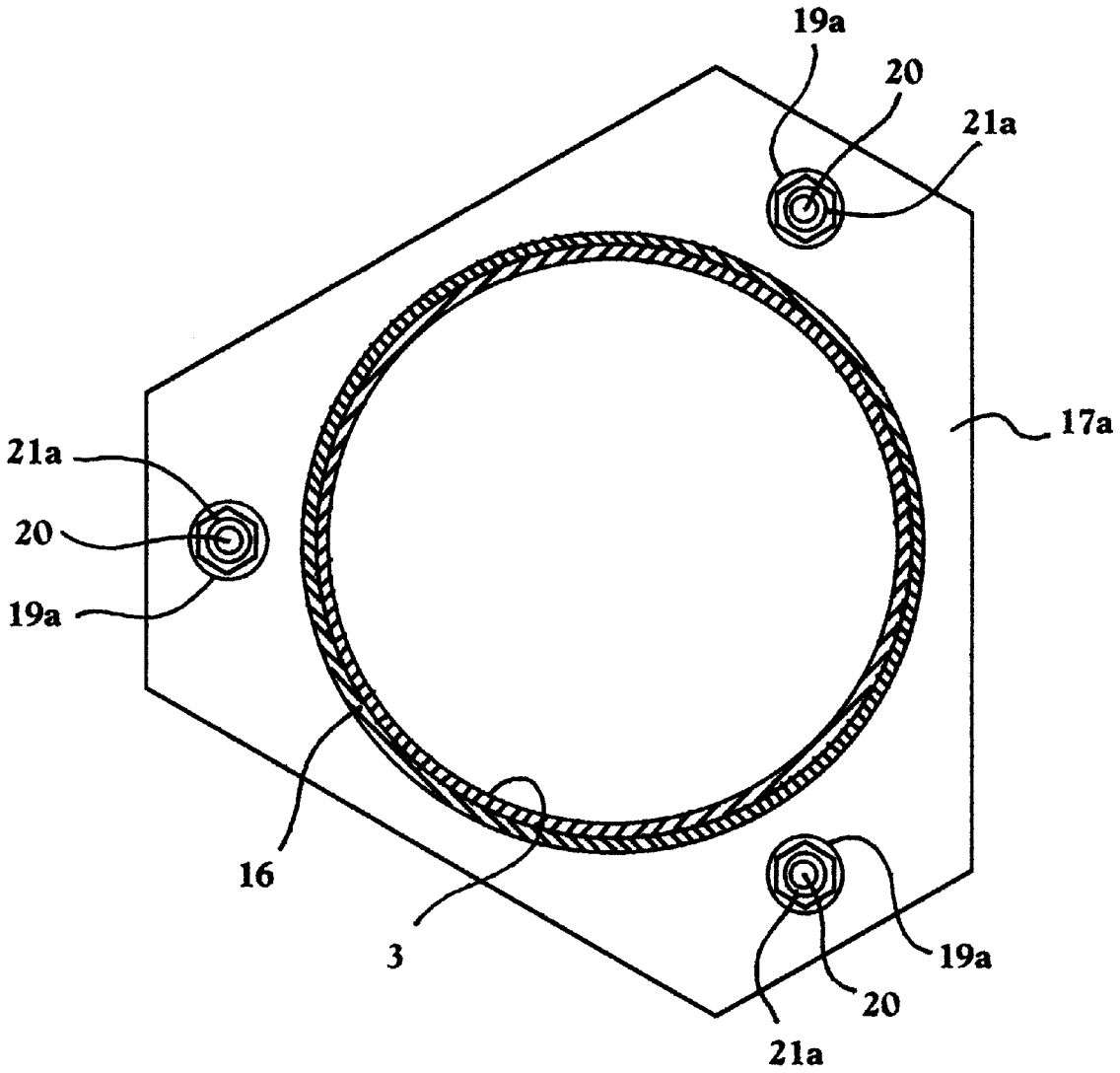
FIG. 3 is a cross sectional view showing the vibration isolating installation mechanism for a disposer of the present invention along the A—A line of FIG. 2.

The present invention can satisfy the contradictory performance by a constitution as described below. FIGS. 2 and 3 show a first embodiment of the present invention. In this embodiment, the same components as in the above basic structure are indicated by the same symbols, to avoid double explanation.

In this embodiment, a support cylinder 16 supported by threaded engagement with the externally threaded portion 5 of the outlet-connected cylinder 3 is provided independent of the clamp 4, and a support collar 17*a* is protruded outwardly from the support cylinder 16 while a support collar 17*b* is also protruded outwardly from the disposer-installing cylinder 7. The support collars 17*a* and 17*b* are formed respectively like an equilateral triangle with its vertexes truncated, as shown in FIG. 3, and have the mechanism described later near the respective vertexes.

Near the respective vertexes of the support collars 17*a* and 17*b*, fitting holes 18*a* and 18*b* are formed, and the respective fitting holes 18*a* and 18*b* have elastic bushes 19*a* and 19*b* of rubber, etc. inserted. Through both the elastic bushes 19*a* and 19*b* near each of the vertexes, a support rod 20 is fitted, and at both the ends of the support rod 20, stoppers 21*a* and 21*b* are installed. In this embodiment, the support rod 20 has externally threaded portions 22*a* and 22*b* formed at both the ends, to form bolts, and nuts threadedly engaged with the externally threaded portions 22*a* and 22*b* are used as the stoppers 21*a* and 21*b*.

In the above structure, since the disposer proper 8 supported by the flexible cylinder 10 is also supported by the support rods 20 in a suspension structure with vibration isolating effect, the flexible cylinder 10 can have a smaller spring constant to provide a higher vibration isolating effect. The decline of support strength in this case can be compensated by the suspension by the support rods 20. So, even if the flexible cylinder 10 is damaged, the suspension by the support rods 20 can prevent the disposer proper 8 from dropping.

Therefore, the flexible cylinder 13 can be provided as a simple cover for falling kitchen refuse, etc., and in this case, since it is not necessary to take any special strength, vibration isolatability, etc. into account, an antimicrobial material can be used as the flexible cylinder though a compromise in such properties is necessary. The antimicrobial material can be, for example, an antimicrobial rubber produced by adding 0.1% or more of an antimicrobial agent such as an inorganic or organic iodine antimicrobial agent to ordinary rubber or soft plastic, etc.

On the other hand, the support rods 20 can isolate the vibration in vertical and horizontal directions by the elastic bushes 19*a* and 19*b*, and since a suspension structure is adopted, they can move in a certain range especially in the horizontal direction, i.e., in the direction in which the support collars 17*a* and 17*b* rotate relatively, the vibration isolating effect in this direction is very high. Since the disposer proper 8 is greatly vibrated mostly in the horizontal direction due to the structure of the rotation drive source and the kitchen refuse crushing mechanism, the general vibration isolating effect is high.

In the above described first embodiment, the proportions of the loads supported by the flexible cylinder 10 and the support rods 20 can be properly set, depending on the properties of the flexible cylinder 10 such as spring constant.

Figure 4:
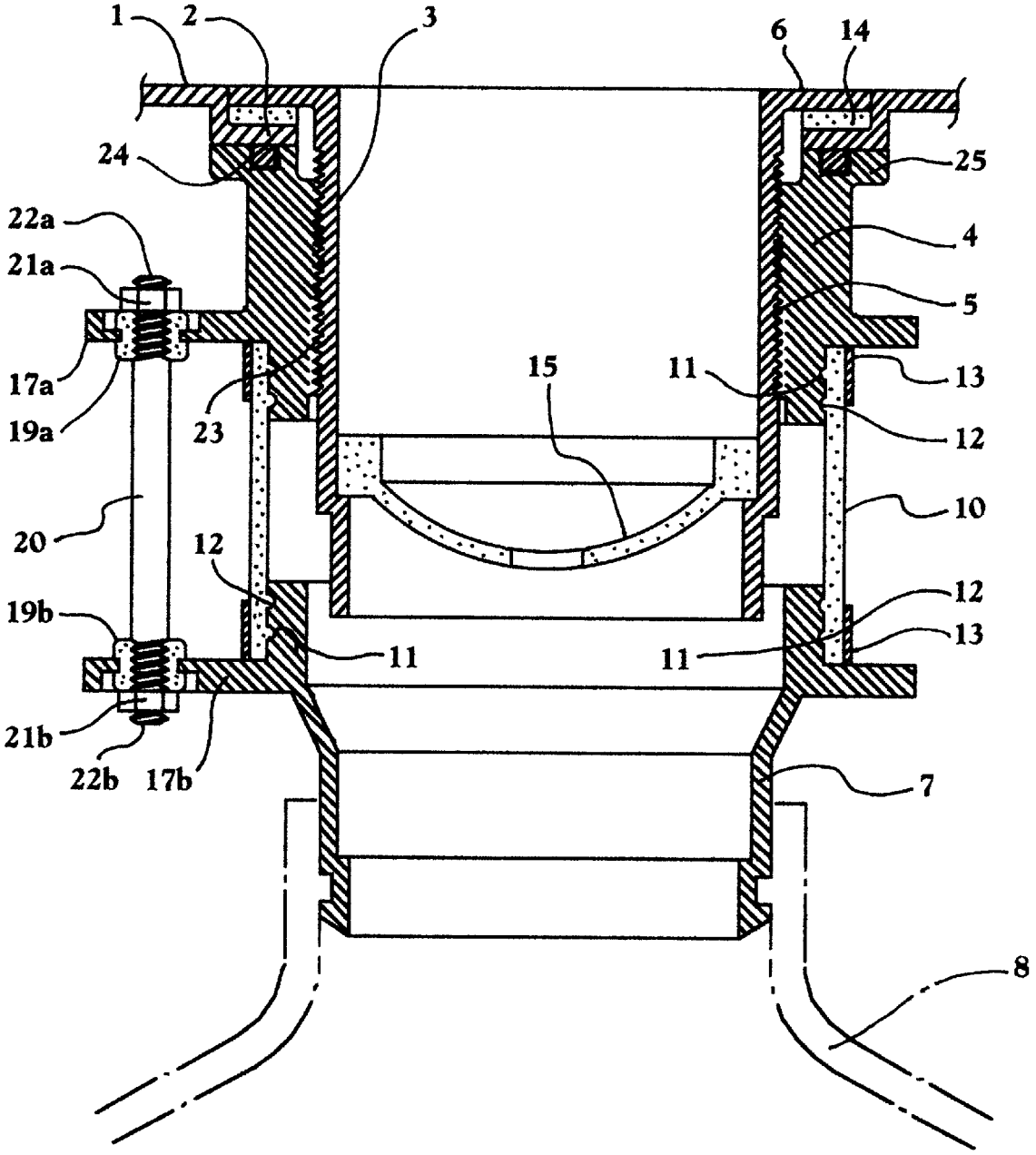
FIG. 4 is a vertical sectional view showing another embodiment of the vibration isolating installation mechanism for a disposer of the present invention.

FIG. 4 shows a second embodiment. Also in the second embodiment, the same components as in the above described basic structure are indicated by the same symbols, to avoid double explanation.

In this embodiment, the support cylinder 23 for protruding the support rods 17*a* are not provided independent of the clamp 4 unlike the first embodiment, but is formed integrally with the clamp 4 at its bottom and is threadedly engaged with the outside of the outlet-connected cylinder 3. Furthermore, the top of the flexible cylinder 10 is not connected with the bottom of the outlet-connected cylinder 3 unlike the first embodiment, but is connected with the bottom of the support cylinder 23 instead.

That is, symbol 23 denotes a support cylinder, and the support cylinder 23 is formed integrally with the clamp 4 at its bottom and is threadedly engaged with the externally threaded portion 5 of the outlet-connected cylinder 3. Around the support cylinder 23 and around the disposer-installing cylinder 7, the support collars 17*a* and 17*b* are protruded as in the first embodiment, and near the respective vertexes of the support collars 17*a* and 17*b*, fitting holes 18*a* and 18*b* are formed. The fitting holes 18*a* and 18*b* have elastic bushes 19*a* and 19*b* of rubber, etc. inserted, and through both the elastic bushes 19*a* and 19*b* near each of the vertexes, the support rod 20 is fitted. At both the ends of the support rod 20, the stoppers 20*a* and 20*b* are installed to form a suspension structure to support the disposer-installing cylinder 7.

On the other hand, at the bottom of the support cylinder 23, like the bottom of the outlet-connected cylinder 3 in the first embodiment, an engaging groove 11 to be engaged with the ridge 12 of the flexible cylinder 10 is formed, so that the ridge 12 formed at the top of the flexible cylinder 10 can be engaged with the engaging groove 11 formed at the bottom of the support cylinder 23 and that the ridge 12 formed at the bottom of the flexible cylinder 10 can be engaged with the engaging groove 11 formed at the top of the disposer-installing cylinder 7. Furthermore, the connection thus achieved is further reinforced by the clamp bands 13 tightened around the flexible cylinder 10.

In the above structure, the outlet-connected cylinder 3 can be arranged coaxially in the flexible cylinder 10, and as shown in FIG. 4, the tip of the outlet-connected cylinder 3 can be protruded into the disposer-installing cylinder 7. In this structure, the kitchen refuse, etc. falling from the outlet-connected cylinder 3 can reach the inside of the disposer proper 8 through the disposer-installing cylinder 7 without any contact with the inside surface of the flexible cylinder 10.

Therefore, the deterioration of the flexible cylinder 10 by the hot oil, hot water, chemicals, detergent, etc. falling with kitchen refuse and the damage of the flexible cylinder 10 by bones, ceramic pieces, glass pieces, etc. can be prevented.

The protrusion of the tip of the outlet-connected cylinder 3 into the disposer-installing cylinder 7 can be adopted also in the first embodiment as expressed by two-dot-dash lines in FIG. 2.

As in the first embodiment, since the disposer proper 8 supported by the flexible cylinder 10 is also supported by the support rods 20 in a suspension structure, the flexible cylinder 10 can have a smaller spring constant to enhance the vibration isolating effect, and the decline of support strength in this case can be compensated by the suspension by the support rods 20. So, even if the flexible cylinder 10 should be damaged, the suspension by the support rods 20 can prevent the disposer proper 8 from dropping. For the flexible cylinder 10, an antimicrobial rubber can also be used as in the first embodiment.

Furthermore in this embodiment, since the tip of the outlet-connected cylinder 3 is protruded into the disposer-installing cylinder 7, water leak, etc. can be prevented even if the flexible cylinder 10 should be damaged.

In this embodiment, the support cylinder connected with the flexible cylinder 10 is integral with the clamp 4 as described above, but can also be independent of the clamp 4 as in the first embodiment.

In FIG. 4, symbol 24 denotes an O ring which can also be applied in other embodiments.

Figure 5:
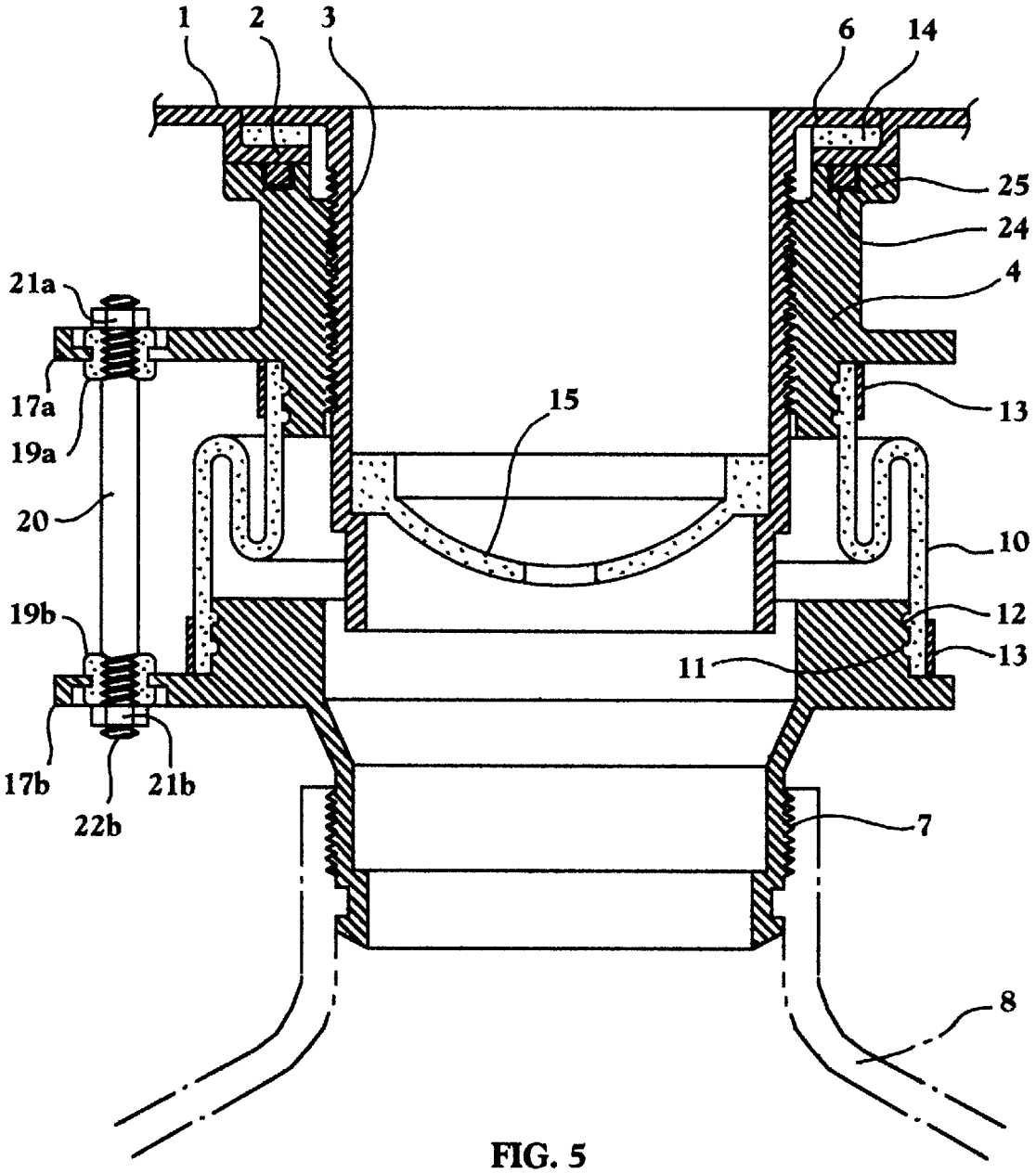
FIG. 5 is a vertical sectional view showing a further other embodiment of the vibration isolating installation mechanism for a disposer of the present invention.

FIG. 5 shows a third embodiment. In this embodiment, the flexible cylinder 10 in the second embodiment is changed in form. Also in this embodiment, the same components as in the above mentioned basic structure are indicated by the same symbols, to avoid double explanation.

In this embodiment, the flexible cylinder 10 connected between the bottom of the support cylinder 23 and the disposer-installing cylinder 7 is not a simple cylinder, but is formed as a bellows, particularly in FIG. 5, as a bellows folded back twice in the axial direction of the cylinder.

This structure has all the above mentioned advantages of the second embodiment, and in addition, since the spring constant of the flexible cylinder 10 can be kept small even if a thick vibration isolating material is used as the flexible cylinder 10, both sufficient vibration isolation and sufficient durability can be achieved advantageously.

Figure 6:
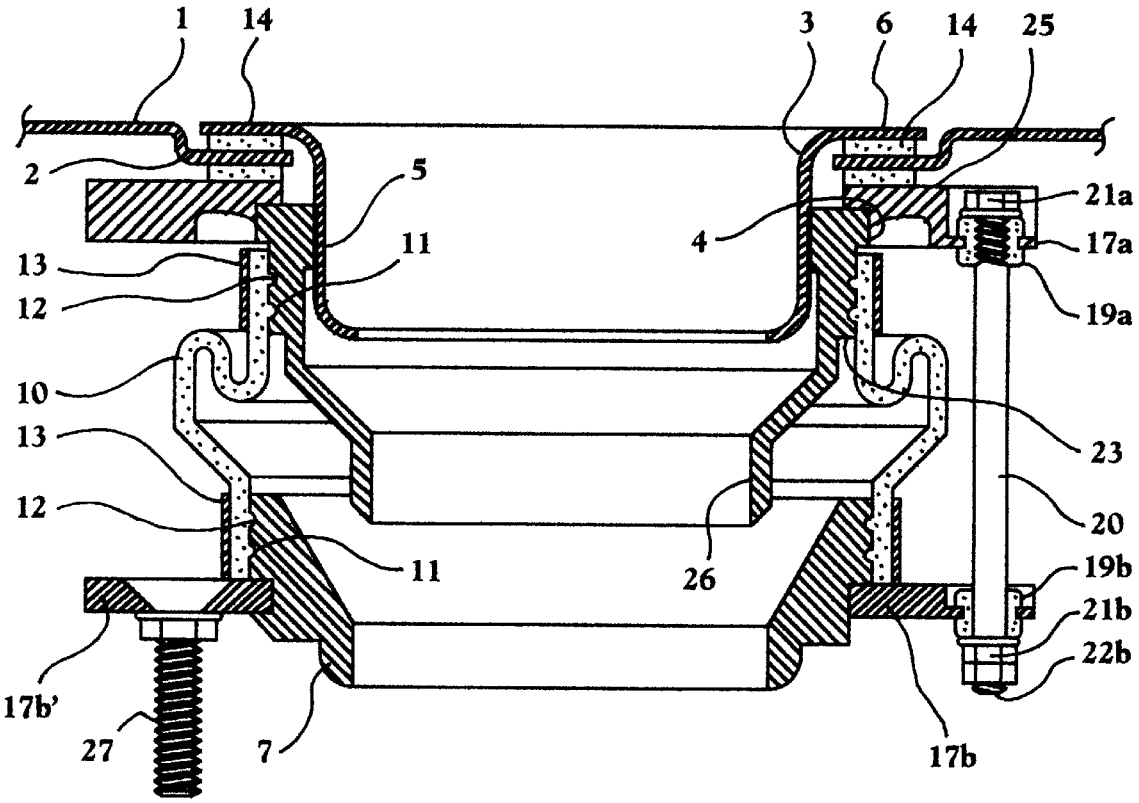
FIG. 6 is a vertical sectional view showing a still further other embodiment of the vibration isolating installation mechanism for a disposer of the present invention.

FIG. 6 shows a fourth embodiment. Also in the fourth embodiment, the same components as in the above mentioned basic structure are indicated by the same symbols, to avoid double explanation.

In this embodiment, the collar portion 25 of the clamp 4 in the third embodiment is formed at the same level as the support collar 17*a*.

So, this embodiment has the following advantages in addition to all the above mentioned advantages of the third embodiment.

In this embodiment, since the support collar 17*a* is formed at the same level as the collar portion 25 on its extension, the height of the installation mechanism can be shortened compared to the embodiment shown in FIG. 5 in which the support collar 17*a* is placed apart below the collar portion 25.

Furthermore, in this embodiment, a cylinder 26 arranged coaxially inside the flexible cylinder 10 is not placed on the extension of the outlet-connected cylinder 3 unlike the third embodiment, but on the extension of the bottom of the support cylinder 23 installed below the clamp 4. Also in this structure, the kitchen refuse, etc. falling from the outlet-connected cylinder 3 reaches the inside of the disposer proper 8 through the disposer-installing cylinder from the cylinder 26 below the support cylinder 23 without any contact with the inside surface of the flexible cylinder 10.

Therefore, as described before, the deterioration of the flexible cylinder 10 by the hot oil, hot water, chemicals, detergent, etc. falling with kitchen refuse and the damage of the flexible cylinder 10 by bones, ceramic pieces, glass pieces, etc. can be prevented.

Symbol 27 denotes a flat head bolt for installing the disposer proper, and a plurality of flat head bolts 27 are installed in the support collar 17*b*.

Figure 7:
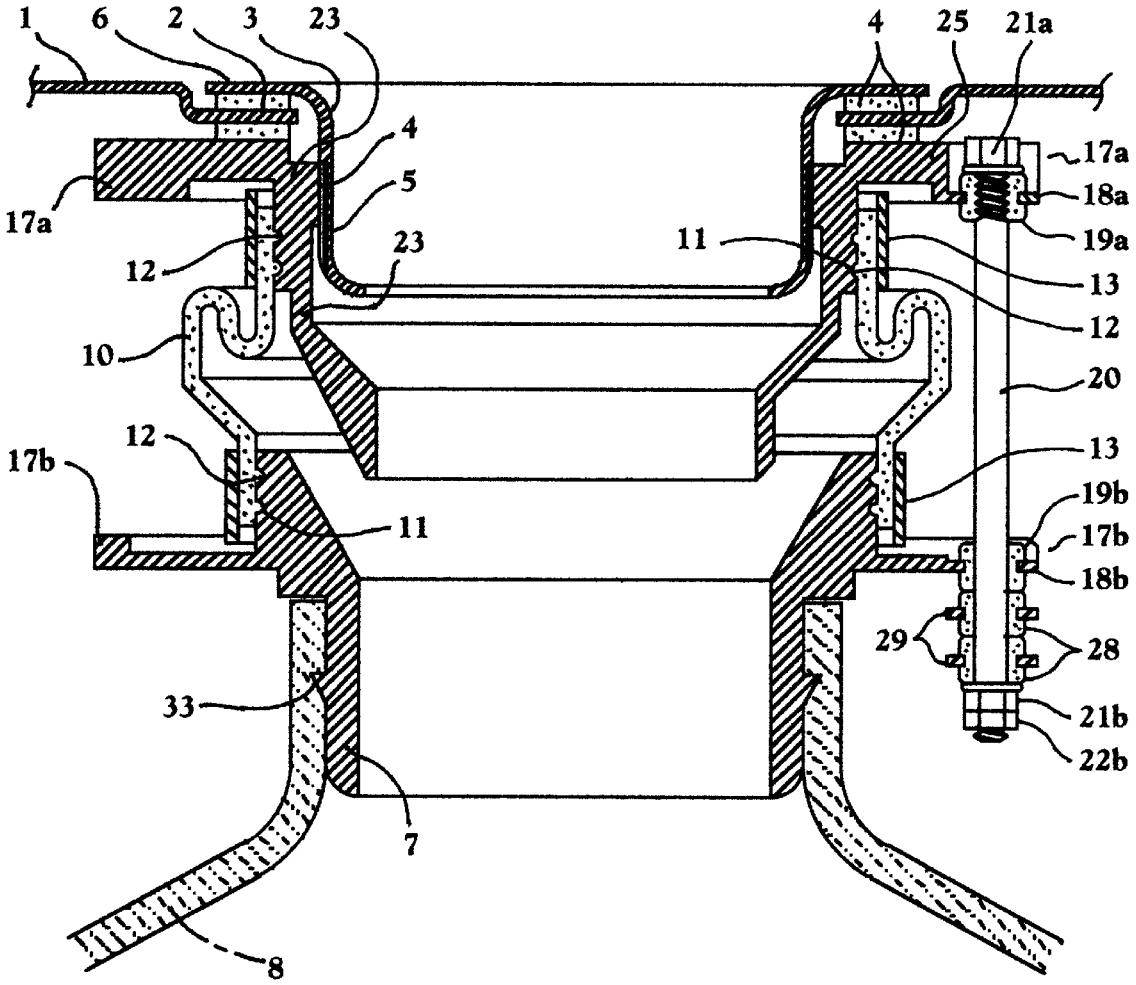
FIG. 7 is a vertical sectional view along the B—B line of FIG. 8 showing a still further other embodiment of the vibration isolating installation mechanism for a disposer of the present invention.
Figure 8:
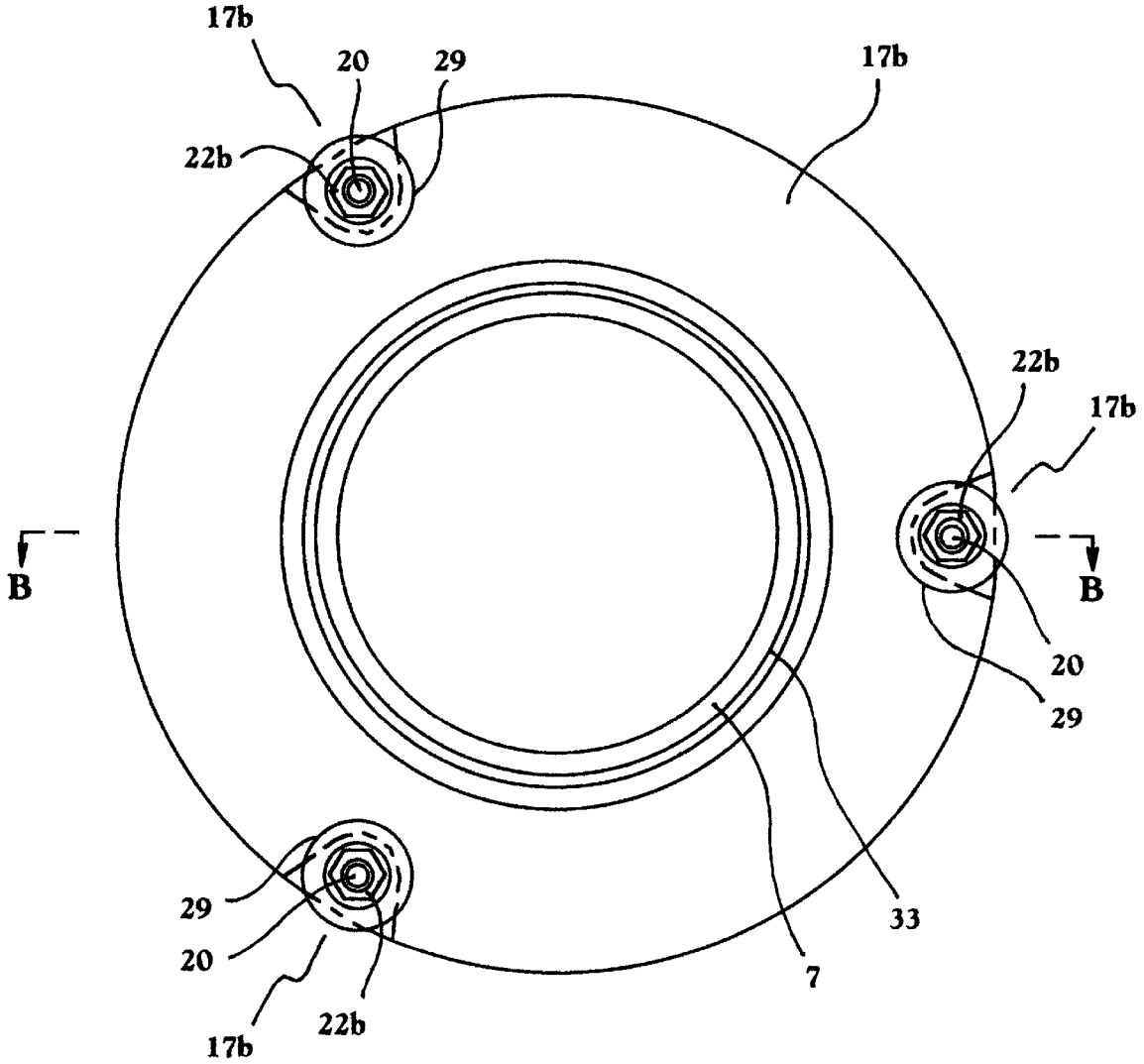
FIG. 8 is a bottom view of the vibration isolating installation mechanism for a disposer of the present invention viewed from the bottom of FIG. 7.

FIGS. 7 and 8 show a fifth embodiment. Also in the fifth embodiment, the same components as in the above mentioned basic structure are indicated by the same symbols, to avoid double explanation.

This embodiment is almost similar to the fourth embodiment. Therefore, it has all the advantages of the fourth embodiment, and in addition, has a characteristic suspension structure.

The support collars 17*a* and 17*b* are circular, not like an equilateral triangle with its vertexes truncated as shown in FIG. 3. At respectively a plurality of mating positions of the support collars 17*a* and 17*b*, i.e., at respectively three positions apart from each other by 120 degrees in FIG. 8, fitting holes 18*a* and 18*b* are formed with their peripheral edges thinned to allow elastic bushes 19*a* and 19*b* formed by rubber tubes to be installed.

After the elastic bushes 19*a* and 19*b* have been installed in the fitting holes 18*a* and 18*b*, a bolt 20 as a support rod is inserted from above the elastic bush 19*a* at each of the three positions, to pass through the top elastic bush 19*a* and the bottom elastic bush 19*b*.

On the tip side portion of the bolt 20 below the bottom elastic bush 19*b*, a proper number of other elastic bushes, say, two elastic bushes 28 are fitted to overlie each other, and nuts 21*b* and 22*b* are tightened in this state, to fix the distance adjusted between the top and bottom support collars 17*a* and 17*b*. Thus, the disposer-installing cylinder 7 can be supported to the outlet-connected cylinder 3 in a suspension structure by the bolts 20. The nut 21*a* is fastened by a locking agent. The nuts 21*b* and 22*b* are a double nut prevented from being loosened. In this embodiment, the bolts 20 correspond to said support rods, and the nuts 21*a* and the nuts 21*b* and 22*b* of the bolts 20 correspond to stoppers.

In this structure, when the disposer proper 8 is operated, the kitchen refuse falling into the outlet-connected cylinder 3 open in the sink falls into the disposer proper 8 through the outlet-connected cylinder 3, the cylinder 26 and the disposer-installing cylinder 7, for disposal by a rotary cutter, etc.

In this case, the vibration of the disposer proper 8 is transmitted to the disposer-installing cylinder 7, but the disposer-installing cylinder 7 is suspended by the bolts 20 through the elastic bushes 19*b*, 28 and 28 at a plurality of positions of the support collar 17*b*, and the bolts 20 are supported by the support collar 17*a* through the elastic bushes 19*a*. So, the transmission of vibration to the support collar 17*a* is inhibited.

In this embodiment, the elastic bushes 19*a* and 19*b* are provided between the bolts 20 and the support collars 17*a* and 17*b*, and in addition, around each of the bolts 20, a proper number of elastic bushes 28 and 28 overlying each other are installed in addition to the elastic bush 19*b* installed between the bolt 20 and the support collar 17*b* of the disposer-installing cylinder 7. So, the vibration transmitted from the disposer proper 8 to the disposer-installing cylinder 7 is absorbed by the elastic bushes 19*b*, 28 and 28, to inhibit that the vibration is transmitted in the horizontal direction and in the vertical direction for isolating vibration.

Especially since a proper number of elastic bushes 28 are overlying around the bolt 20, in addition to the elastic bush 19*b* installed between the bolt 20 and the support collar 17*b* of the disposer-installing cylinder 7, the elastic portion is long to provide a large effect of inhibiting the transmission of vibration.

Since the elastic portion is long due to the overlying elastic bushes, compressive force acts on the portion, but since the bolt 20 is passed through the elastic bushes, it does not happen that the elastic bushes are buckled by the load.

In this embodiment, since the two elastic bushes 28 are kept in position by plain washers 29 installed in the grooves provided around them, they are prevented from being buckled or deformed more than necessary. Since the two elastic bushes 28 are not required to be inserted in the fitting holes 18*a* and 18*b* unlike the elastic bushes 19*a* and 19*b*, it is not essentially required that the installation grooves are formed. Therefore, simple elastic tubes can also be used instead of elastic bushes.

Figure 9:
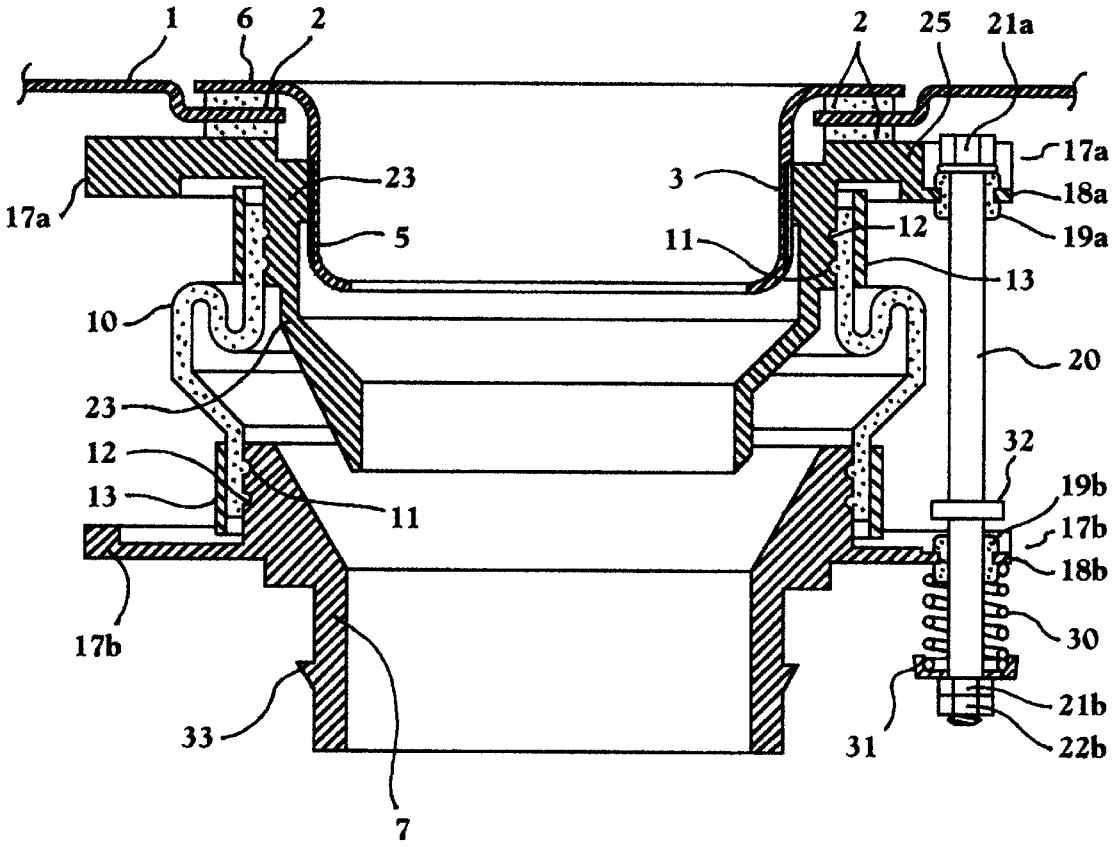
FIG. 9 is a vertical sectional view showing a still further other embodiment of the vibration isolating installation mechanism for a disposer of the present invention.

FIG. 9 shows a sixth embodiment. In the sixth embodiment, a compression coil spring 30 is placed between the support collar 17*b* of the disposer-installing cylinder 7 and the nut 21*b* at each of the support rods, instead of a proper number of elastic bushes 28 adopted in the fifth embodiment. Therefore, this embodiment has the following advantages in addition to all the advantages of the fourth embodiment. Also in this embodiment, the same components as in the basic structure are indicated by the same symbols, to avoid double explanation.

Symbol 31 denotes a spring retainer, and 32 is a stopper to prevent the movement in the direction to narrow the distance between the disposer-installing cylinder 7 and the outlet-connected cylinder 3 more than necessary by the compression coil spring 30 in any no-load state, for example, when the disposer-installing cylinder 7 does not have the disposer proper 8 installed yet or when the vibration isolating installation mechanism is commercially distributed. Symbol 33 denotes a disposer-installing ridge.

In this structure, since the compression coil spring 30 is installed around the bolt 20, in addition to the elastic bush 19*b* installed between the bolt 20 and the support collar 17*b* of the disposer-installing cylinder 7, to make the elastic portion long, the effect of inhibiting the transmission of vibration is large. Furthermore, though compressive force acts on the elastic portion since the compression coil spring 30 makes the elastic portion long, there is no possibility that the disposer proper 8 drops even if the coil spring 30 is damaged. That is, because of the suspension structure, the support of the disposer proper 8 is safely sustained even if the elastic portion should be damaged.

Figure 10:
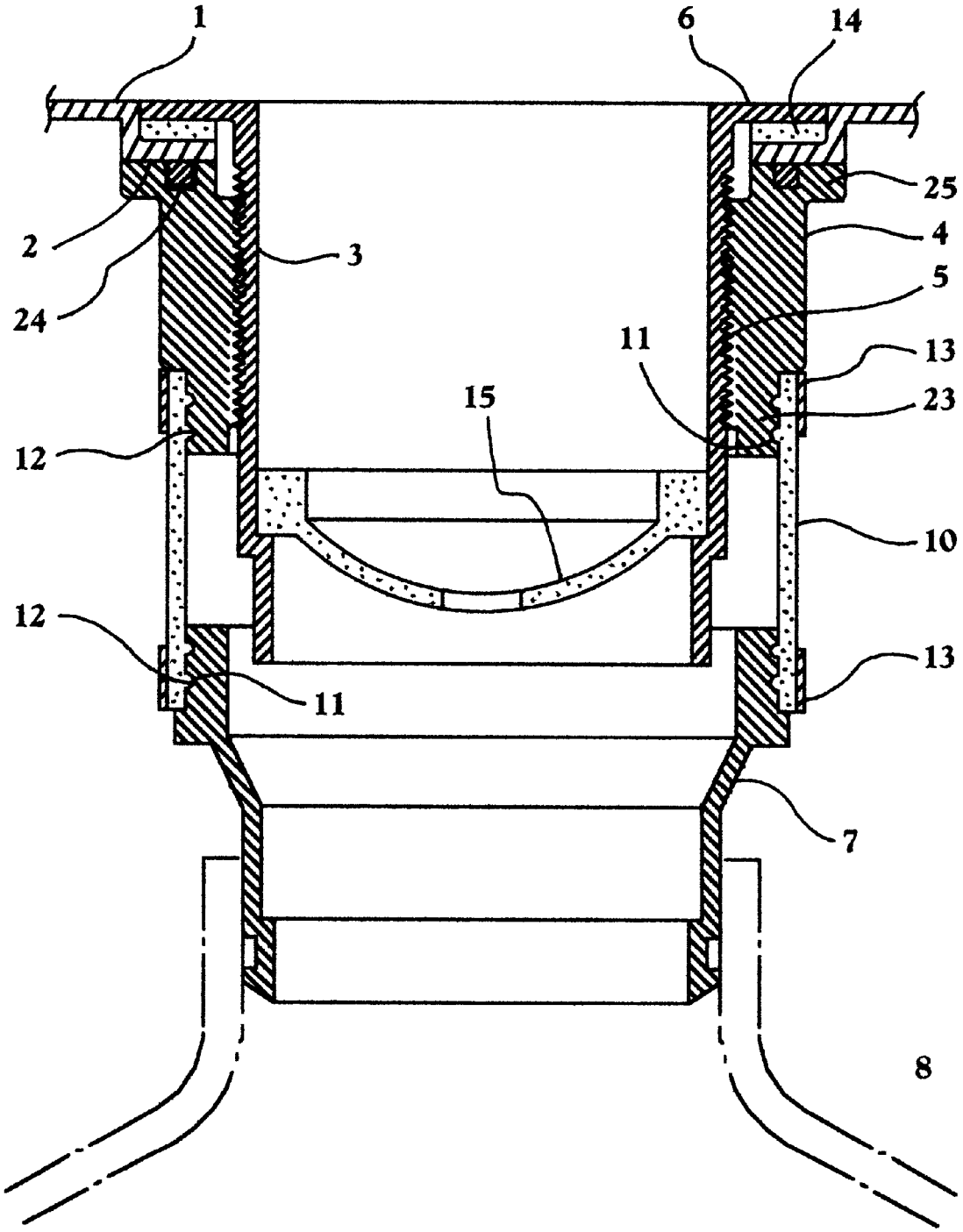
FIG. 10 is a vertical sectional view showing a still further other embodiment of the vibration isolating installation mechanism for a disposer of the present invention.

FIG. 10 shows a seventh embodiment of the present invention. In this embodiment, the support collars 17*a* and 17*b* adopted in the second embodiment shown in FIG. 4 are not adopted, and the suspension structure by the support rods is not adopted. However, in this embodiment, the outlet-connected cylinder 3 is arranged coaxially inside the flexible cylinder 10, and the tip of the outlet-connected cylinder 3 can be protruded into the disposer-installing cylinder 7. Therefore, as described before, the kitchen refuse, etc. falling from the outlet-connected cylinder 3 can reach the inside of the disposer proper 8 through the disposer-installing cylinder 7 without any contact with the inside surface of the flexible cylinder 10. Therefore, the deterioration of the flexible cylinder 10 by the hot oil, hot water, chemicals, detergent, etc. falling with kitchen refuse and the damage of the flexible cylinder 10 by bones, ceramic pieces, glass pieces, etc. can be prevented.

Figure 11:
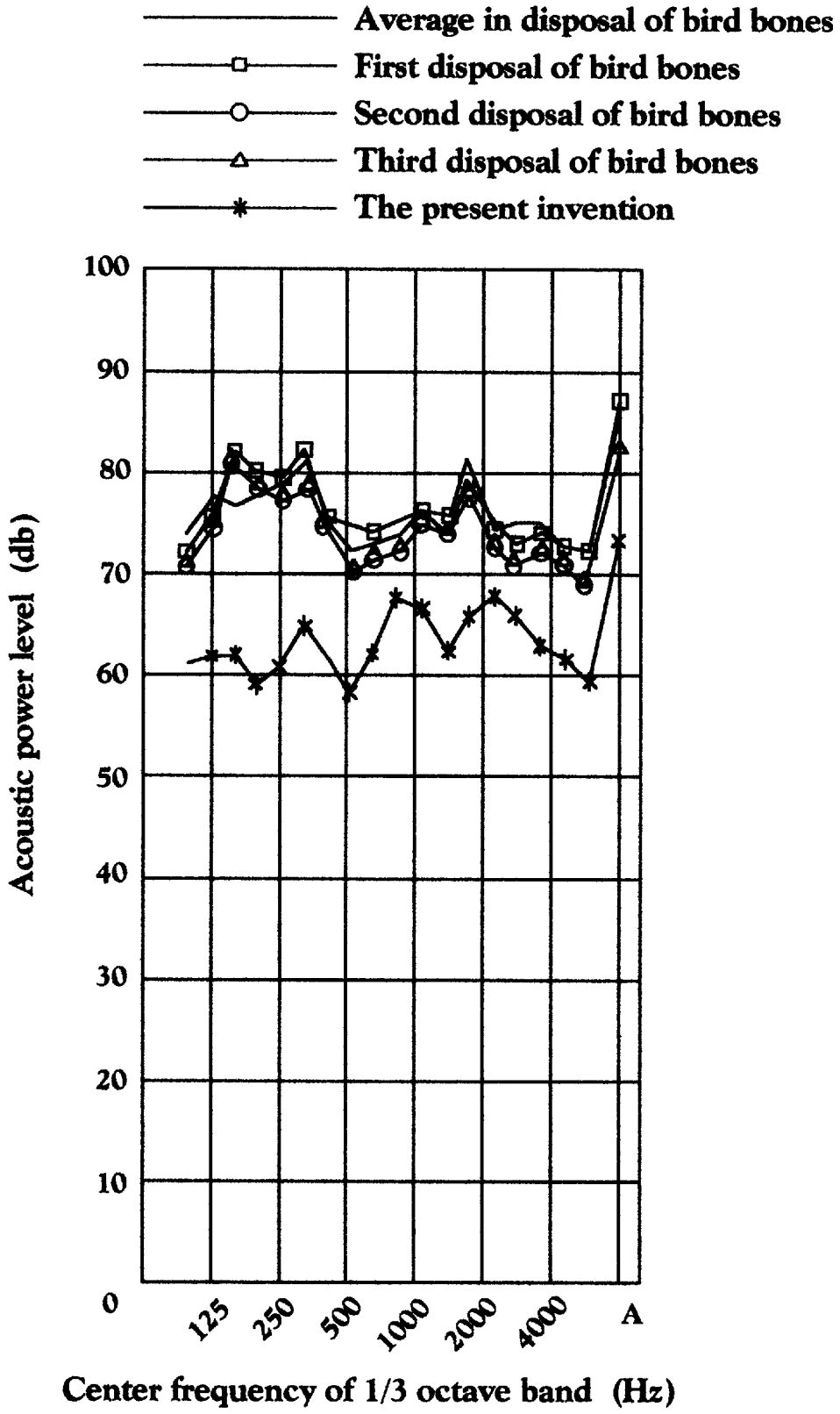
FIG. 11 is a graph for illustrating the noise reducing effect by the vibration isolating installation mechanism for a disposer of the present invention.
Figure 12:
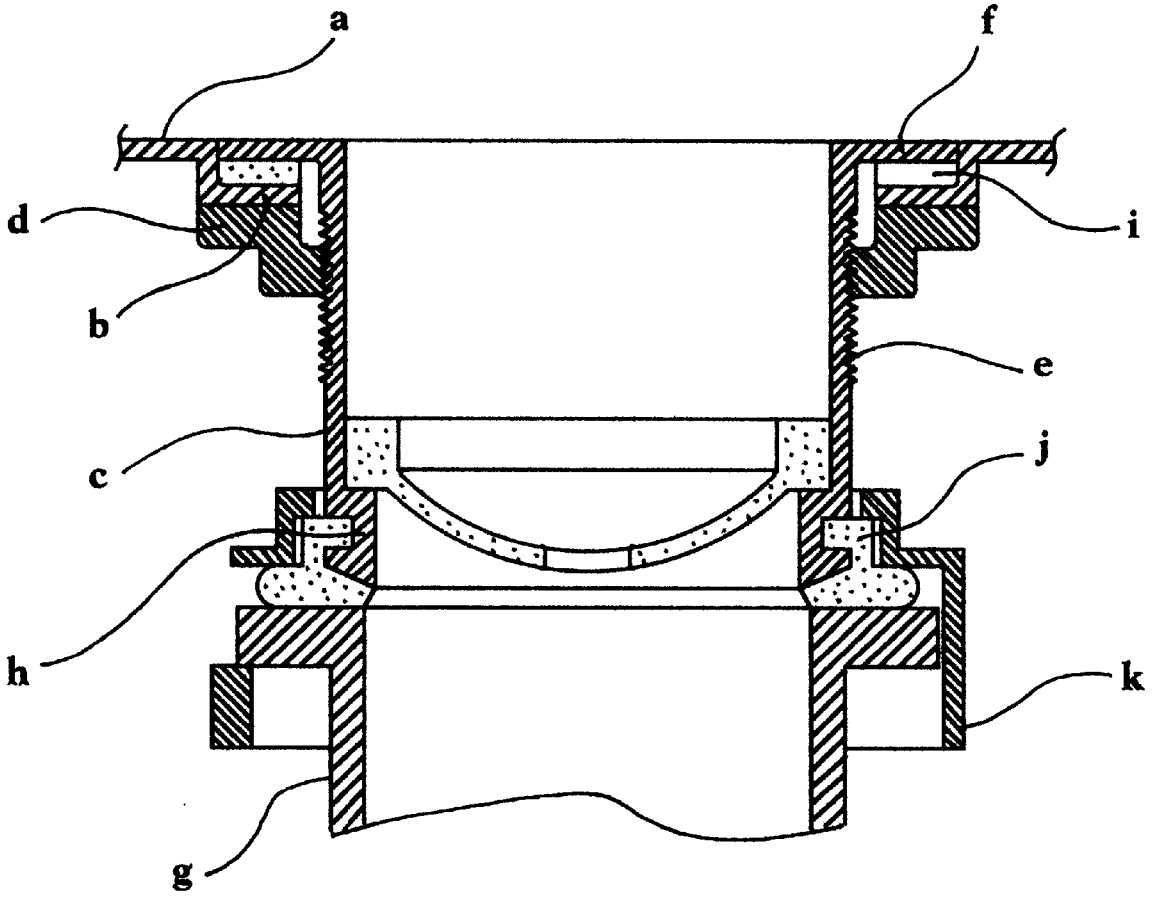
FIG. 12 is a vertical sectional view showing a conventional disposer installation mechanism.

FIG. 11 shows noise levels measured when a disposer was operated by applying the vibration isolating installation mechanism of the present invention, for example, the seventh embodiment or applying the conventional installation mechanism. The asterisked solid line shows the results of the present invention.

As can be seen from the graph, if the vibration isolating installation mechanism of the present invention is applied, the noise can be sufficiently damped.

The vibration isolating installation mechanism for a disposer of the present invention as described above has the following effects:

1. The transmission of vibration from the disposer proper to the sink can be inhibited by the flexible cylinder. So, the noise of the sink caused by the vibration of the disposer proper can be greatly reduced.

2. Since the disposer proper is supported by the suspension structure as well as by the flexible cylinder, the spring constant of the flexible cylinder can be kept smaller to enhance the vibration isolating effect without impairing the support strength, and even if the flexible cylinder is damaged for example, it can be prevented that the disposer proper drops.

3. Since elastic portions are compressed by a load in the suspension structure, the support of the disposer proper is safely sustained even if the elastic portions are damaged.

4. The elastic portions can be formed to be longer to enhance the vibration isolating effect in the vertical direction, and also in this case, since the support rods are passed through the elastic portions, it does not happen that the elastic portions are buckled by compressive force.

5. If the structure is formed in such a manner that the kitchen refuse, etc. falling from the sink outlet does not contact the flexible cylinder, the flexible cylinder can be prevented from being deteriorated and damaged.

6. The flexible cylinder can be arranged as a simple cover for falling kitchen refuse, etc. In this case, since it is not necessary to take any special strength, vibration isolatability, etc. into account, an antimicrobial rubber suitable for use in such a place can be used as the material of the cover though a compromise in such properties is necessary.

We claim:

1. A vibration isolating installation mechanism for a disposer, comprising an outlet-connected cylinder installed in the outlet of a sink by a clamp, to protrude downward, a disposer-installing cylinder for installing a disposer proper, a flexible cylinder connected between the outlet-connected cylinder and the disposer-installing cylinder, a support cylinder placed around the outlet-connected cylinder, support collars protruded horizontally respectively from the support cylinder and the disposer-installing cylinder, mating fitting holes formed in the support collars of both the cylinders at the respectively corresponding positions, support rods loosely fitted in the respectively mating fitting holes through an elastic bush respectively, and stoppers fitted at both the ends of each of the support rods.

2. The vibration isolating installation mechanism for a disposer, according to claim 1, wherein the support cylinder is threadedly engaged with the outside of the outlet-connected cylinder independent of the clamp.

3. A vibration isolating installation mechanism for the disposer, according to claim 1, wherein the support cylinder is integrally formed with the clamp at its bottom and is threadedly engaged with the outside of the outlet-connected cylinder.

4. A vibration isolating installation mechanism for a disposer, according to claim 1, wherein the flexible cylinder is formed like a bellows.

5. The vibration isolating installation mechanism for a disposer, according to claim 1, wherein the tip of the outlet-connected cylinder is protruded into the disposer-installing cylinder.

6. The vibration isolating installation mechanism for a disposer, according to claim 1, wherein the tip of the support cylinder is protruded into the disposer-installing cylinder.

7. The vibration isolating installation mechanism for a disposer, according to claim 1, wherein the flexible cylinder is made of an antimicrobial rubber.

8. A vibration isolating installation mechanism for a disposer, according to claim 1, wherein for the support collar of at least the disposer-installing cylinder, elastic tubes are installed between the stopper and the elastic bush at each of the support rods.

9. A vibration isolating installation mechanism, according to claim 8, wherein the elastic tubes are elastic bushes.

10. The vibration isolating installation mechanism for a disposer, according to claim 1, where for the support collar of at least the disposer-installing cylinder, a compression coil spring is installed between the stopper and the elastic bush at each of the support rods.

11. A vibration isolating installation mechanism for a disposer, comprising an outlet-connected cylinder installed in the outlet of a sink by a clamp, to protrude downward, a disposer-installing cylinder for installing a disposer proper, a support cylinder placed around the outlet-connected cylinder, a flexible cylinder connected between the support cylinder and the disposer-installing cylinder, support collars protruded horizontally respectively from the support cylinder and the disposer-installing cylinder, mating fitting holes formed in the support collars of both the cylinders at the respectively corresponding positions, support rods loosely fitted in the respectively mating fitting holes through an elastic bush respectively, and stoppers fitted at both the ends of each of the support rods.

12. The vibration isolating installation mechanism for a disposer of claim 11, wherein the support cylinder is threadedly engaged with the outside of the outlet-connected cylinder independent of the clamp.

13. The vibration isolating installation mechanism for a disposer of claim 11, wherein the support cylinder is integrally formed with the clamp at its bottom and is threadedly engaged with the outside of the outlet-connected cylinder.

14. The vibration isolating installation mechanism for a disposer of claim 11, wherein the flexible cylinder is formed like a bellows.

15. The vibration isolating installation mechanism for a disposer of claim 11, wherein the tip of the outlet-connected cylinder is protruded into the disposer-installing cylinder.

16. The vibration isolating installation mechanism for a disposer of claim 11, wherein the tip of the support cylinder is protruded into the disposer-installing cylinder.

17. The vibration isolating installation mechanism for a disposer of claim 11, wherein the flexible cylinder is made of an antimicrobial rubber.

18. The vibration isolating installation mechanism for a disposer of claim 11, wherein for the support collar of at least the disposer-installing cylinder, elastic tubes are installed between the stopper and the elastic bush at each of the support rods.

19. The vibration isolating installation mechanism for a disposer of claim 11, where, for the support collar of at least the disposer-installing cylinder, a compression coil spring is installed between the stopper and the elastic bush at each of the support rods.

* * * * *